US008146504B2

(12) United States Patent
Wallner et al.

(10) Patent No.: US 8,146,504 B2
(45) Date of Patent: Apr. 3, 2012

(54) SYSTEM FOR PROTECTION IN PARTICULAR OF LARGE FLYING PLATFORMS AGAINST INFRARED AND/OR RADAR-GUIDED THREATS

(75) Inventors: Christian Wallner, Bayerisch Gmain (DE); Heinz Bannasch, Schönau (DE); Rainer Gaisbauer, Schönau (DE); Vikorn Kadavanich, Bayerisch Gmain (DE)

(73) Assignee: Rheinmental Waffe Muntion GmbH, Ratingen (DE)

( * ) Notice: Subject to any disclaimer, the term of this patent is extended or adjusted under 35 U.S.C. 154(b) by 0 days.

(21) Appl. No.: 12/087,943

(22) PCT Filed: Jan. 5, 2007

(86) PCT No.: PCT/EP2007/000048

§ 371 (c)(1),
(2), (4) Date: Jul. 17, 2008

(87) PCT Pub. No.: WO2007/087948

PCT Pub. Date: Aug. 9, 2007

(65) Prior Publication Data

US 2009/0007768 A1 Jan. 8, 2009

(30) Foreign Application Priority Data

Jan. 20, 2006 (DE) ..... 10 2006 003 036
Feb. 1, 2006 (DE) ..... 10 2006 004 912

(51) Int. Cl.
*F42B 8/00* (2006.01)

(52) U.S. Cl. ..... 102/505

(58) Field of Classification Search ..... 102/505
See application file for complete search history.

(56) References Cited

U.S. PATENT DOCUMENTS 2,856,185 A 10/1958 Whipple
3,150,848 A * 9/1964 Lager ..... 244/3.16
3,216,410 A * 11/1965 Trombatore et al. ..... 124/75
3,519,221 A * 7/1970 Kifor ..... 342/12
3,898,795 A * 8/1975 Barker ..... 60/39.281
4,453,675 A * 6/1984 Kodadek et al. ..... 239/675

(Continued)

FOREIGN PATENT DOCUMENTS

DE 25 27 205 12/1976

(Continued)

*Primary Examiner* — Michael Carone
*Assistant Examiner* — Samir Abdosh
(74) *Attorney, Agent, or Firm* — Lucas & Mercanti, LLP; Klaus P. Stoffel

(57) ABSTRACT

A protection system (10) is proposed which comprises a storage container (1), a transport unit (2), an activation unit (3), an ejection unit (4), a monitoring/control unit (5) and a user unit/interface (6), as well as at least one effect body (7). This system (10) is integrated at the front in a flying carrier (11), and a modular system (10), with the object of positioning spoof measures in a defined manner, in this case by means of the effect body (7). The various effect bodies (7) are preferably activated and initiated in a controlled manner without any physical contact, in the same way as pneumatic or mechanical ejection of these effect bodies (7). The effect bodies (7) are packets without any munitions, and are responsible for the actual effect of the system (10) outside the carrier (11).

15 Claims, 2 Drawing Sheets

U.S. PATENT DOCUMENTS

| | | | | |
|---|---|---|---|---|
| 4,679,483 | A * | 7/1987 | Wrana | 89/1.51 |
| 5,773,745 | A * | 6/1998 | Widmer | 89/1.11 |
| 5,835,051 | A | 11/1998 | Bannasch et al. | |
| 5,915,694 | A * | 6/1999 | Brum | 273/359 |
| 7,400,287 | B2 * | 7/2008 | Saccomanno | 342/12 |
| 7,717,356 | B2 * | 5/2010 | Petersen | 239/8 |
| 2002/0117073 | A1 | 8/2002 | Brum | |
| 2004/0200381 | A1 * | 10/2004 | Zatterqvist | 102/505 |
| 2006/0096493 | A1 * | 5/2006 | Swanson | 102/505 |
| 2009/0108138 | A1 * | 4/2009 | Mintz et al. | 244/173.3 |

FOREIGN PATENT DOCUMENTS

| | | |
|---|---|---|
| DE | 196 01 165 | 7/1997 |
| DE | 196 17 701 | 11/1997 |
| DE | 2 353 087 | 2/2001 |
| DE | 100 16 781 | 10/2001 |
| DE | 103 46 001 | 5/2005 |
| EP | 0 036 239 | 9/1981 |
| EP | 0 511 946 | 11/1992 |
| GB | 2309070 | 7/1997 |
| WO | WO 01/36896 | 5/2001 |

* cited by examiner

SYSTEM FOR PROTECTION IN PARTICULAR OF LARGE FLYING PLATFORMS AGAINST INFRARED AND/OR RADAR-GUIDED THREATS

This is a U.S. National Stage of application No. PCT/EP 2007/000048, filed on Jan. 5, 2007. Priority is claimed on that application and on the following applications:

Country: Germany, Application No.: 10 2006 003 036.2 Filed: Jan. 20, 2006; and

Country: Germany, Application No.: 10 2006 004 912.8 Filed: Feb. 1, 2006.

BACKGROUND OF THE INVENTION

The invention concerns an integrated system for protecting even civil flying platforms from various threats.

Infrared-guided, radar-guided, and dual-mode guided missiles are used, among other things, to combat, for example, marine targets, such as ships, or other objects on land and in the air. After they have been launched, these missiles or rockets fly, initially under inertial guidance (e.g., DE 196 01 165 A1) or GPS guidance to the target area.

To deceive guided missiles of this type, various decoys are used in order to protect objects by hindering the missiles by interfering with their function. Some decoys transmit electromagnetic decoy signals when a threat is identified (DE 100 16 781 C2), while others disperse "clouds" of floating dipoles (chaff clouds) that are tuned to the radar frequency of the missile.

A large number of these decoys is deployed to confuse the enemy search, since this produces additional targets besides the actual target object. During a missile attack, after the missile has locked on to the target, a seduction decoy is deployed. To deflect the missile, these decoys have, for example, a larger radar reflection cross section than the target object itself.

A method of protecting a target object that simulates the object is published in WO 01/36896. In this case, the silhouette of a ship is simulated.

The applicant's own patent application DE 103 46 001 A1 describes a method and a device for protecting ships from end-stage guided missiles. The decoy munition described in the cited document has integrated, electronically freely programmable delay elements, in which the delay times transmitted by a launcher or fire-control computer are stored. The decoys have their own energy storage.

Another application by the present applicant, namely, DE 196 17 701 A1, deals with a method for producing a decoy target. The active materials are positioned by a shell that has been caused to rotate. A preferred embodiment uses the idea of discharging the active materials, including an activation and distribution device, together from the shell case during the flight phase of the shell by means of a discharge part and then activating and distributing the active materials.

None of the prior art solutions provides for protection of civil targets, especially flying platforms. As is well known, flares require complicated sensor technology, which makes them expensive, and present a hazard due to the explosives they contain. DIRCM (directed infrared countermeasures) likewise have the disadvantage that they are cost-intensive and likewise require complicated sensor technology. Especially for use as protective measures in a civil aircraft, flares of this type and DIRCM are unsuitable, since they pose a hazard to the public due to falling and/or burning residual parts of a flare, cause annoyance to the passengers due to the noise associated with the deployment of the protection, and require complicated integration in the aircraft itself. It is also necessary to consider the external protuberances on the airplane and the associated impairment with respect to aerodynamics and fuel consumption.

SUMMARY OF THE INVENTION

The objective of the invention is to specify a protection system that guarantees adequate protection from infrared-guided and/or radar-guided threats, even in the civil sector.

The invention is based on the idea of developing a munition-free concept. Conventional flares or DIRCM are not to be used. Therefore, in a further development, to avoid undefined deflections of a threat that is flying in, the invention proposes to integrate a modular system into especially a flying platform with the task of well-defined placement of spoof measures with a high degree of attractive capability. The active bodies, which can be safely handled, are conveyed from a storage container integrated in the platform to an activation unit by means of a transport unit. In the activation unit, the active bodies are activated according to their task and then ejected. No explosives are used. Additionally or alternatively, the active bodies can be activated outside the system.

The invention proposes a protection system that consists of at least one storage container, (preferably) at least one transport unit, at least one activation unit, (preferably) at least one ejection unit, at least one monitoring/control unit, at least one user unit/interface, and at least one active body. It is possible to dispense with a transport unit if, for example, the storage container and the activation unit form a single unit. It is also possible to dispense with the ejection unit if the active bodies are provided with sufficient velocity by the transport unit (for example, a pneumatic tube conveyor) and are dynamically thrust to the outside through the activation unit.

This system is integrated primarily in a flying carrier and is a modular system with the task of well-defined placement of spoof measures, in this case by means of active bodies. The active bodies are preferably activated or initiated in a controlled manner without any physical contact, and they are ejected by pneumatic or mechanical means. The active bodies are munition-free packets which are responsible for the actual effect of the system outside the carrier.

Computer-assisted controllability results in many degrees of freedom for the total system with respect to the action, the duration of action, the intensity and number of active bodies, and the development of effect, the separation and the geometry of the active bodies.

Advantages associated with this are that no munition in the conventional sense is involved, the active bodies are initiated noiselessly, and safe handling is ensured. The active bodies are no longer destroyed, remnants are avoided, and no sensor technology is necessary. This makes the active body itself cost-effective. The system can be retrofitted and offers the possibility of preventive deployment. It has a long duration of action and a low weight.

The invention is explained in greater detail below with reference to the specific embodiment illustrated in the drawings.

DETAILED DESCRIPTION OF THE INVENTION

Figure 1:
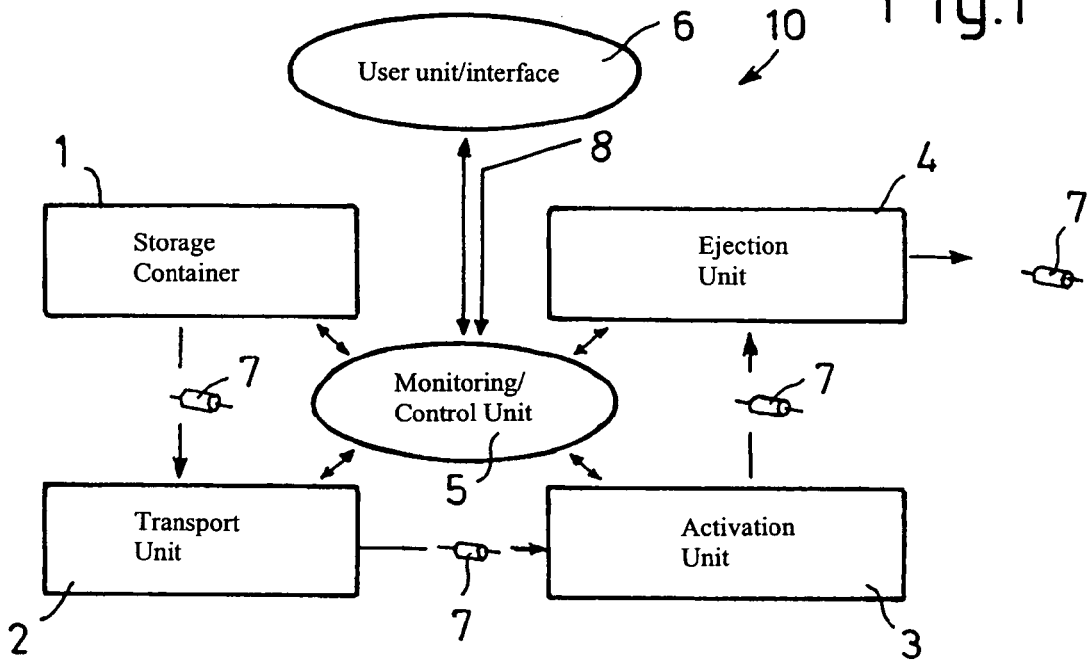
FIG. 1 is a schematic drawing of the protection system.
Figure 2:
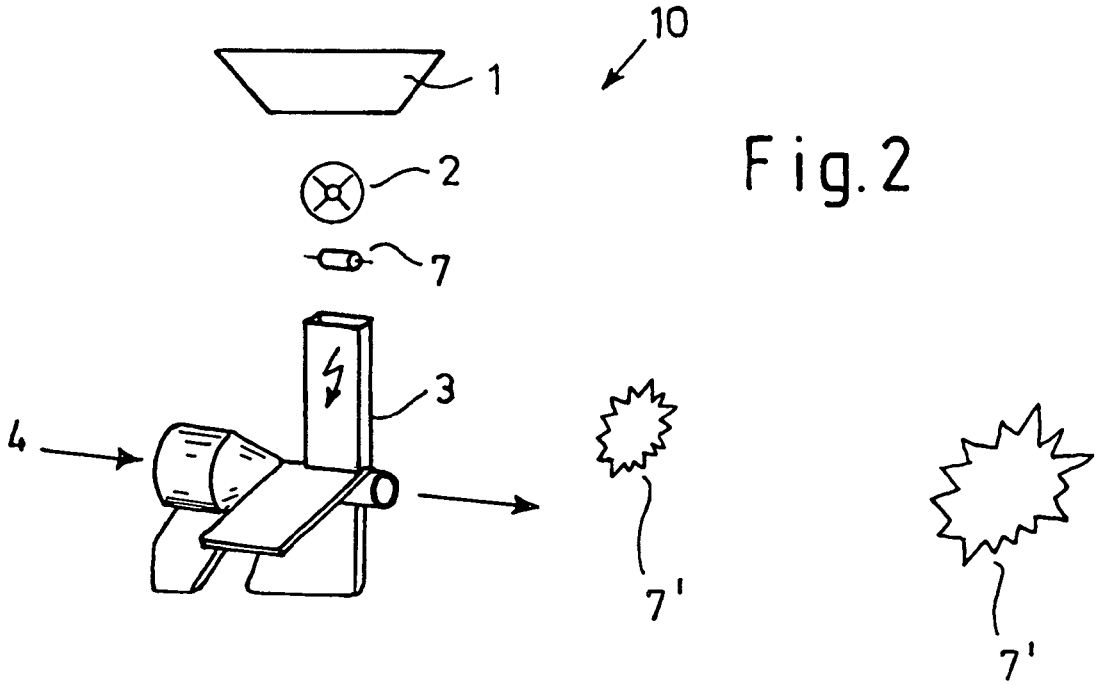
FIG. 2 is a pictorial schematic representation of the protection system

FIG. 1 schematically shows a protection system 10 with its essential components of a storage container 1, transport unit 2, activation unit 3, ejection unit 4, monitoring/control unit 5, user unit/interface 6, and at least one active body 7. This system is integrated primarily in a flying carrier 11 (FIG. 3) and is a modular system 10 with the task of well-defined placement of spoof measures, in this case by means of the active bodies 7.

The storage container 1 is preferably a reusable, fire-resistant, sealed case or container for supplying the active bodies 7. It is a type of storage container with the possibility of mechanical connection to the transport unit 2. The container 1 can be exchanged for another quickly and in an uncomplicated way and ensures the supply of a sufficient number of active bodies 7, even with mixed loading. This measure makes it possible to reload the system at any time if several containers 1 are carried along.

The transport unit 2 is preferably a conveyor belt system that is responsible for the fast and sequential transport of the active bodies 7 for activation. Alternatives are also possible, such as a pneumatic tube conveyance system.

The activation unit 3 is designed in a way that ensures that the various active bodies 7 are activated or initiated in a controlled manner without any physical contact. This contact-free controlled activation is preferably realized by hot air or laser light, etc. Alternatively, initiation with contact is possible.

To avoid pyrotechnic ejection, the ejection unit 4 should have a pneumatic or mechanical system that allows pneumatic or mechanical ejection of the active bodies 7. These could be fast, electrically switching valves or springs.

The monitoring and control unit 5 has a, for example, stored-program control system to guarantee the reliability of the system 10 and has the function of controlling and monitoring the individual components. It has an interface with the carrier 11, for example, a BUS or interface unit.

The user unit 6 contains the operating elements in the cockpit of the carrier 11 to be protected. Relevant system information for a user (not shown in detail) can be displayed graphically or the like on the user unit 6.

The active bodies 7 are munition-free packets which are responsible for the actual effect of the system 10 outside the carrier. The active material is preferably red phosphorus, chaff, or the like.

The system 10 operates in the following way:

Active bodies 7 that are safe to handle are conveyed by the transport unit 2 from the storage container 1 to the activation unit 3, where they are activated according to their task. The infrared active bodies can be initiated, for example, by hot air or laser. The activated active bodies 7 are then ejected by the ejection unit 4 by suitable means, preferably by pneumatic or mechanical means. The system 10 is operated via the user unit 6. Computer-assisted controllability is realized by the control unit 5 and makes it possible to set the action (preferably infrared, radar), the duration of action, and the intensity, for example, by appropriate active bodies 7, by deployment of variable portions, and by the number of active bodies 7 deployed. The unfolding of the effect can also be controlled, namely, by well-defined activation and separation and by well-defined ejection. The variable deployment method also allows different geometries of the active bodies 7.

Figure 3:
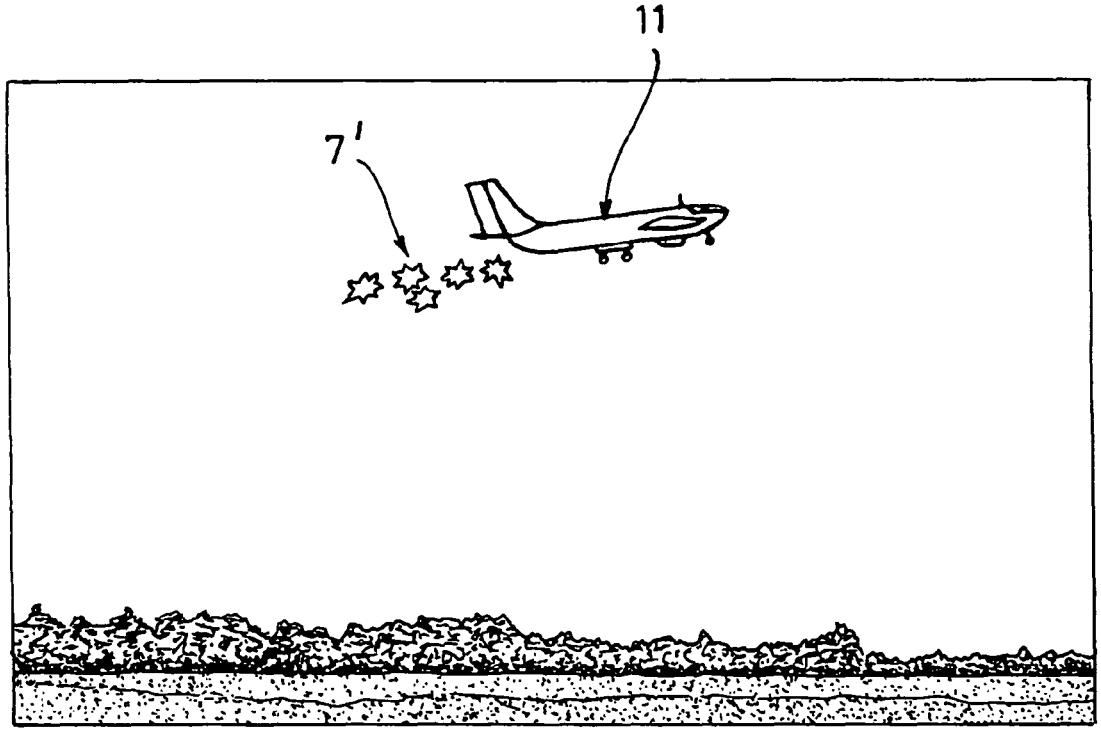
FIG. 3 is a drawing that shows the protection system in action.

FIG. 3 shows an example of the protection system in action after the active bodies 7' have been activated and ejected.

The invention claimed is:

1. A protection system, comprising:

at least one storage container;

an activation unit;

a monitoring and control unit for monitoring and controlling individual components of the system;

a user unit;

a plurality of active bodies arranged in the storage container;

at least one transport unit capable of fast and sequential transport of the active bodies to the activation unit for activation; and an ejection unit operative to eject the active bodies, wherein the storage container supplies the active bodies, the activation unit activates the active bodies and is operative to ensure that the various active bodies are activated or initiated in a controlled manner with or without any physical contact, wherein the system is integrated in a carrier and the active bodies are munition-free packets responsible for an actual effect of the system outside the carrier, wherein the storage container is mechanically, releasably and exchangeably connected to the carrier so as to be reusable.

2. The protection system in accordance with claim 1, wherein the storage container is a reusable, fire resistant, sealed case or container for supplying the active body, whereby the container is exchangeable for another container.

3. The protection system in accordance with claim 1, wherein the transport unit is a conveyor belt system.

4. The protection system in accordance with claim 1, wherein the transport unit is a pneumatic tube conveyance system.

5. The protection system in accordance with claim 1, wherein various active bodies are provided, the activation unit being operative to activate the various active bodies with contact.

6. The protection system in accordance with claim 1, wherein the ejection unit has a pneumatic or mechanical system that allows pneumatic or mechanical ejection of the active body.

7. The protection system in accordance with claim 6, wherein the ejection unit includes fast, electrically switching valves or springs.

8. The protection system in accordance with claim 1, wherein the monitoring and control unit has a stored-program control system.

9. The protection system in accordance with claim 1, wherein the monitoring and control unit has an interface with the carrier.

10. The protection system in accordance with claim 1, wherein the active bodies provide an infrared and radar effect.

11. The protection system in accordance with claim 1, wherein the system is integrated in a flying carrier.

12. The protection system in accordance with claim 10, wherein the active bodies are red phosphorus or chaff.

13. The protection system in accordance with claim 1, wherein the monitoring and control unit provides computer-assisted controllability for setting action, duration of action, and intensity of action of the active bodies by deployment of variable portions and numbers of the active bodies.

14. The protection system in accordance with claim 1, wherein an unfolding effect of the active bodies is controlled by well-defined activation and separation during well-defined ejection.

15. The protection system in accordance with claim 1, wherein the active bodies have different geometries.

* * * * *